US006202334B1

(12) United States Patent
Reynolds et al.

(10) Patent No.: US 6,202,334 B1
(45) Date of Patent: Mar. 20, 2001

(54) POINT-OF-PURCHASE ADVERTISING BY A CANTILEVERED DISPLAY MECHANISM AND RELATED METHODS

(75) Inventors: Randy B. Reynolds; Ali A. Rasekhi; George Allen Allred, all of Salt Lake City, UT (US)

(73) Assignee: Randy Reynolds, Salt Lake City, UT (US)

( * ) Notice: Subject to any disclaimer, the term of this patent is extended or adjusted under 35 U.S.C. 154(b) by 0 days.

(21) Appl. No.: 09/239,918

(22) Filed: Jan. 28, 1999

(51) Int. Cl.[7] ..... G09F 3/18

(52) U.S. Cl. ..... 40/642.02; 40/608

(58) Field of Search ..... 40/642.02, 661.03, 40/608, 771; 248/548, 549, 483; 24/514, 518

(56) References Cited

U.S. PATENT DOCUMENTS

| | | | |
|---|---|---|---|
| D. 243,639 | 3/1977 | Escalante . | |
| D. 245,945 | 9/1977 | Mihojevich . | |
| 900,590 | 10/1908 | Raymond . | |
| 1,367,830 | 2/1921 | Poole | 40/608 |
| 1,410,662 | 3/1922 | Even . | |
| 1,412,580 | 4/1922 | Thayer . | |
| 1,443,204 | 1/1923 | Bernstein | 40/608 |
| 1,760,270 | 5/1930 | Griswold | 40/608 |
| 1,903,683 | 4/1933 | Nute | 40/608 |
| 2,541,303 | 2/1951 | Smith . | |
| 2,654,172 | 10/1953 | Solomon | 40/618 |
| 2,787,433 | 4/1957 | Slavsky . | |
| 2,817,131 | 12/1957 | Seegers | 40/620 X |
| 2,924,902 | 2/1960 | Luck et al. . | |
| 3,015,177 | 1/1962 | Hembd et al. | 248/231.21 X |
| 3,041,760 | 7/1962 | Slavsky . | |
| 3,070,911 | 1/1963 | Slavsky . | |
| 3,084,463 | 4/1963 | Guyer et al. . | |
| 3,189,187 | 6/1965 | Guyer, Jr. et al. | 248/231.21 X |
| 3,226,866 | 1/1966 | de Poray | 40/442 X |
| 3,517,937 | 6/1970 | Glass et al. . | |
| 3,696,541 | 10/1972 | Pittman | 40/620 |
| 3,931,689 | 1/1976 | Shine . | |
| 4,028,828 | 6/1977 | Chao et al. . | |
| 4,055,014 | 10/1977 | Schmidt et al. | 40/442 |
| 4,096,656 | 6/1978 | Diceglie | 40/564 |
| 4,317,303 | 3/1982 | Sernovitz | 40/564 |
| 4,682,430 | 7/1987 | Ramsay | 40/5 |
| 4,805,331 | 2/1989 | Boggess et al. | 40/651 |
| 4,819,353 | 4/1989 | Glucksman et al. . | |

(List continued on next page.)

FOREIGN PATENT DOCUMENTS

| | | |
|---|---|---|
| 497867 | 5/1930 | (DE) . |
| 469487 | of 1914 | (GB) . |

OTHER PUBLICATIONS

Computerized P–0–P Signs Provide for Instant Changes of Promotions; Jul.–Aug. 1994, Technology.

*Primary Examiner*—Joanne Silbermann
(74) *Attorney, Agent, or Firm*—Foster & Foster

(57) ABSTRACT

Novel point-of-purchase cantilevered deflectable display assemblies, which normally extend transversely into a shopping aisle. Display assemblies which accommodate substitution of one frame-carried form or configuration of advertising for another, which can be radically different, without disconnecting the entire display assembly from its mounting to a molding at a store shelf or like. The advertising frame with which the advertising medium is associated is removably connected to a hanger portion. The hanger portion accommodates the above-mentioned on-site frame and advertisement removal and exchange while the remainder of the display assembly remains in its shelf-mounted or like position. Display assemblies are disclosed which enhance the deflectable nature of the cantilevered distal part of the display assemblies, the manner in which pivoting occurs and is controlled or limited and the way in which the display assemblies are biased toward neutral in the assembled condition.

7 Claims, 9 Drawing Sheets

U.S. PATENT DOCUMENTS

| | | | |
|---|---|---|---|
| 4,881,707 | 11/1989 | Garfinkle | 248/221.4 |
| 4,909,464 | 3/1990 | Levine | 248/225.1 |
| 4,924,363 | 5/1990 | Kornelson . | |
| 4,984,693 | 1/1991 | Belokin, Jr. et al. . | |
| 4,991,338 | 2/1991 | Jones | 40/642 X |
| 5,083,765 | 1/1992 | Kringel . | |
| 5,111,606 | 5/1992 | Reynolds . | |
| 5,207,349 | 5/1993 | Kringel . | |
| 5,233,773 | 8/1993 | Reynolds . | |

POINT-OF-PURCHASE ADVERTISING BY A CANTILEVERED DISPLAY MECHANISM AND RELATED METHODS

FIELD OF THE INVENTION

The present invention relates generally to point-of-purchase product advertising and more particularly to such advertising using novel deflectable cantilevered lighted display mechanisms which extend generally transversely into a shopping aisle in a grocery store, a supermarket, a discount center or the like.

BACKGROUND

Point-of-purchase advertising in grocery stores and similar businesses has existed for a very long time. A number of advertising techniques have been employed with the goal of enhancing the sales volume of advertised products. Some of the advertising techniques of the past, which target a specific product, have had little impact on sales, while others have caused a measurable increase in sales. Most sales increases in the past have been modest. Thus, the quest has continued for better ways to enhance sales of a given product, among many other available products, offered along a shopping aisle in a retail store.

Typically, the manufacturer of a product, which is to receive target point-of-purchase advertising in a retail store, places or contracts for the placement of the advertising adjacent to the product, stored on a shelf, in a refrigerated cabinet or on a rack. The costs of such advertising must be balanced against the increase in sales of the product, if any, which is the subject of the target advertising. Key factors in respect to such point-of-purchase advertising are: (1) the extent to which the attention of prospective customers is attracted directly and meaningfully to the product receiving the target advertising over and above other available products; (2) the comparative cost of the advertised product; and (3) the cost and convenience of installing, maintaining and varying the target advertising. Most prior art point-of-purchase display devices have not produced a large increase in sales.

Until recently, the prior art of point-of-purchase advertising displays have sometimes comprised rigid and static displays supported by a shelf such that the advertising thereof faces the aisle while being generally flush with the shelf. Such signs are known to sometimes provide illumination, but such illumination is obscure because it is directed transversely into the aisle from difficult to observe locations between shelves which contains goods in the form of stacked cans or packages, for example. One must be in the aisle directly in front of the display in order to effectively see the illumination. Also, the advertising indicia of the sign is parallel to the aisle, requiring the potential purchaser to be directly in front of the sign in order to read and understand the advertising indicia. See U.S. Pat. No. 3,015,177 and U.S. Pat. No. 4,924,363 for examples.

As an alternative, the earlier prior art teaches use of a non-illuminating deflectable display assembly which is mounted in cantilevered fashion to extend transversely into a shopping aisle. See U.S. Pat. No. 4,805,331. A top eccentric torsion spring biases the display assembly toward the neutral position counter to any displacement by a shopping cart, for example. This type of sign does not adequately attract the singular attention of potential buyers.

In addition, it is known to provide an illuminated deflectable display mechanism which comprises a permanent cantilevered frame indirectly mounted to shelf molding in which one or more advertising cards are inserted. See U.S. Pat. No. 5,233,773, issued to one of the present inventors. While the advertising cards are removable and replaceable, the overall configuration and nature of the advertising region is fixed. It is, therefore, impossible to vary the peripheral limits and the basic nature of advertising, though card content may vary. A deflection-accommodating spring or other return is connected directly to the proximal part of the frame or, in the alternative, an eccentric elevated torsion spring returns the frame, after lateral deflection, to its neutral position. If a peripherally different sign is desired, the entire display assembly must be removed and replaced by something else, if available.

Prior art point-of-purchase display assemblies fail to accommodate substantial variation in the nature, the configuration, including the peripheral make-up, and the content of the advertising segment of a display assembly without requiring disconnection and removal of the entire display assembly from its mounting upon a molding at a shelf edge or on the face of a refrigerator cabinet.

Also, the nature of a centrally-disposed return spring for cantilevered display assemblies of the prior art typically requires attachment of the return spring directly to the proximal end of the frame, which frame surrounds the area of advertising. Thus, the central return spring not only biases the display assembly toward neutral, but also fully supports the weight of the cantilevered frame and the contents thereof while singularly absorbing the deflection impact of shopping carts against the frame. As a consequence, the life of the return spring is relatively short and as the spring begins to lose its resiliency or strength, the display frame may not continue to return to neutral and/or may sag.

Furthermore, provision of illumination systems for such display assemblies has posed certain problems related to size, location and access to and vandalism of sources of power comprised of batteries.

In addition, insertion, retention and removal from the peripheral frame of advertising cards has presented difficulties including but not limited to wear and tear, soiling, vandalism and unauthorized removal.

BRIEF SUMMARY AND OBJECTS OF THE PRESENT INVENTION

In view of the foregoing, the present invention overcomes or substantially alleviates problems of the prior art. The present invention embodies improvements in point-of-purchase cantilevered deflectable display assemblies which gain the singular attention of consumers thereby significantly enhancing sales of the products which are the subject of the target advertising and which allow temporary deflections out of the orthogonal or neutral position due to an external force.

Display assemblies embodying the present invention are convenient to install and maintain and, further, accommodate facile on-site change in the nature and configuration of the advertising from time-to-time.

In brief summary, the present invention accommodates substitution of one frame-carried form or configuration of advertising for another, which can be radically different, without disconnecting the entire display assembly from its mounting to a molding at a store shelf or like. The advertising frame with which the advertising medium is associated is removably connected to a hanger portion. The hanger portion accommodates on-site frame and advertisement removal while the remainder of the display assembly remains in its shelf-mounted or like position. An entirely different advertising frame and associated advertisement may be substituted by connecting a different advertising frame or the like to the hanger portion.

The present invention also comprises novel display assemblies which enhance the deflectable nature of the cantilevered distal part of the display assemblies, the manner in which pivoting occurs and is controlled or limited and the way in which the display assemblies are biased toward neutral in the assembled condition.

In a preferred form of the invention, a proximal molding clamp is affixed to a base. The base may be adjustable in respect to the molding clamp to accommodate adjustment in the angle of presentation, such as leveling of the display assembly. The base, at its distal part, pivotably interfaces uniquely with a hanger portion, which in turn releasibly or removably attaches to a frame portion which holds the advertising. At least part of the cantilevered weight and each impact load imposed by a shopping cart or a shopper are transferred across the hanger part, the base and the clamp to the molding. Thus, the weight and external loads imposed upon a return mechanism are greatly reduced, thereby enhancing the life of the return mechanism. By placing the return mechanism centrally between the base and the hanger portion, the base and hanger portion are caused to compressively though pivotably engage each other, and the hanger portion and frame portion are collectively placed in a neutral position cantilevering transversely though deflectably into a shopping aisle.

The interface between the base and the hanger portion may comprise multiple spaced pivot sites. Rounded male projections and matching female recesses at the interface may define a plurality of spaced pivot axes, to accommodate movement up, down, laterally in one direction and laterally in the other direction, responsive to external forces.

The present invention preferably comprises a novel return mechanism comprising at least two concentric coil springs, which preferably are oppositely wound. A stabilizing strap may be disposed along the center of the internal coil spring. The return mechanism spans between the base and the hanger portion. The return mechanism is internally concealed when the display assembly is in its neutral cantilevered position extending transversely into a shopping aisle and does not fully support the weight of the pivotal part of the display mechanism. The return mechanism is more effective, has a longer life and, in a given embodiment, readily accommodates up, down and lateral displacement or deflection caused by external forces, such as impact or collision by a shopping cart, and return to the neutral position when the external force is removed.

In one form of the invention, a unique illumination system is provided, including a novel access door for facile insertion and removal of batteries, which also reduces the likelihood of vandalism. The present invention may embrace: a flexible aisle display comprised of a self-contained on-site independent electrical power source, circuitry and at least one light; a display mechanism comprised of forward and rear viewing areas providing unobstructed views along the aisle in either direction; and a bi-directional viewable display assembly which does not materially interfere with shelf access and which so singularly captures the focus of shoppers that all shelves where the display is used become primary locations.

The present invention may include a novel transparent plastic carrier in which one or more advertising cards can be conveniently and selectively inserted and removed. The frame is constructed to accommodate selective insertion and removal of the carrier with at least one card therein into the peripheral frame through an access door and an internal slot, which slot is normally inaccessible to shoppers. A tab at the proximal end of the carrier aids in manual insertion and removal.

Given the foregoing, it is a primary object of the present invention to overcome or substantially alleviate problems of the prior art in the field of point-of-purchase advertising display devices.

It is another primary object to provide point-of-purchase cantilevered deflectable display assemblies, and related methods, which singularly gain the attention of consumers to significantly enhance sales of products so advertised.

It is also an important object to provide novel point-of-purchase cantilevered deflectable display assemblies, and related methods, where the display assemblies are convenient to install and maintain and, further, accommodate facile on-site change in the nature and configuration of advertising from time-to-time.

It is a further valuable object to provide a novel cantilevered advertising display assembly, and related methods, which accommodate on-site substitution of one frame-carried form or configuration of advertising for another while the remainder of the assembly remains mounted to a store shelf or like molding along a shopping aisle in a store.

Another paramount object is the provision of a display assembly, and related methods, the assembly comprising a frame which carries an advertising medium and is removably and replaceably connected to a frame hanger, whereby the frame and advertisement carried by the frame may be disconnected and removed from the hanger and replaced by a second frame and advertising segment which is connected to the hanger, while the remainder of the display assembly remains in its shelf-mounted or like position. The second frame and advertising segment may be similar or entirely dissimilar when compared to the first.

Another important object of the present invention is to provide a novel cantilevered display mechanism which uniquely enhances the deflectable or pivotable nature of the cantilevered distal part of the display assembly.

An additional dominant object is the provision of a cantilevered display assembly, and related methods, wherein the manner in which the displacement of the distal part thereof is controlled or limited and the way in which the display assembly is biased toward a neutral position are novelly achieved.

It is also a significant object to provide a novel cantilevered display assembly comprising a molding clamp affixed to a base member wherein structure is provided by which the relationship between the base member and the clamp is adjusted to alter the angle of presentation, including but not limited to leveling of the display assembly.

A further primary object is the provision of a novel deflectable cantilevered display assembly, and related methods, the assembly being comprised of a base which interfaces at a distal part with a pivotable hanger which in turn releasibly attaches to a frame portion which holds advertising whereby at least some of the weight of the assembly and each impact load imposed by a shopping cart or something else are transferred across the hanger, the base and a clamp to a store molding.

Another object of value is the provision of a deflectable cantilevered display assembly comprised of a novel support system and return mechanism by which weight and impact loads are distributed, thereby enhancing the life of the return mechanism.

It is a further significant object to provide a deflectable cantilevered display assembly comprising a novel return mechanism centrally disposed between a hanger and a base so as to cause the hanger and the base to compressively engage each other whereby a distal advertising part is biased into a neutral position cantilevering transversely into a shopping aisle.

An additional paramount object is the provision of a point-of-purchase pivotable display assembly comprising a novel interface between a base and hanger which is comprised of multiple, spaced pivot sites.

A further valuable object is the provision of a deflectable cantilevered display assembly comprising a novel interface relationship between a mounting base and a distal part pivotably engaging the base so as to define multiple, spaced pivot axes accommodating up, down and two-way lateral displacement responsive to external forces.

Another object of importance is the provision of a cantilevered pivotable display assembly comprising a novel return mechanism comprised of two concentric coil springs.

Another object of value is the provision of a cantilevered pivotable display assembly comprising a novel concentric coil spring mechanism comprised of oppositely wound coil springs.

Another object of significance is the provision of a cantilevered pivotable display assembly comprising a novel return mechanism comprised of two concentric coil springs and a stabilizing strap in the hollow center of the interior coil spring.

A further dominant object is the provision of a deflectable cantilevered display assembly comprising a novel longer life return mechanism concealed when the assembly is in a neutral cantilevered position extending transversely into a shopping aisle whereby the return mechanism does not fully support the weight of the assembly and yet accommodates up, down and lateral displacement caused by external forces, such as impact by a shopping cart.

An object of value is the provision of a deflectable cantilevered point-of-purchase display assembly comprising a novel frame-carried illumination system.

An additional paramount object is the provision of a display mechanism comprising a novel frame-carried access door for facile insertion and removal of batteries, which reduces likelihood of tampering and vandalism.

A further object is the provision of a novel carrier for advertising cards for use in display assemblies.

An additional object is to provide a transparent carrier for a cantilevered display assembly in which advertising cards can be conveniently inserted and removed.

A further object is the provision of a transparent carrier for a cantilevered display assembly in which advertising sheets may be inserted and removed, the carrier comprising a proximal tab to facilitate insertion into and removal from a frame of the assembly.

Another object of value is the provision of a cantilevered display assembly comprising an access door and an internal slot through which advertising material is selectively inserted into and removed from a frame of the assembly.

These and other objects and features of the present invention will be apparent from the detailed description taken with reference to the accompanying drawings.

DETAILED DESCRIPTION OF THE ILLUSTRATED EMBODIMENTS

Reference is now made to the drawings, wherein like numerals are used to designate like parts throughout. The drawings are illustrative of cantilevered deflectable illuminated display assemblies or mechanisms which extend orthogonally into a shopping isle in a grocery store, a supermarket, a discount center or the like to enhance sales volume of the advertised products. One such display assembly, embodying the principals of the present invention, is illustrated in the FIGS. 1 through 6. Display assemblies in accordance with the present invention are constructed so as to obtain the singular attention of shoppers in such a way that the product which is the target of the advertising is clearly recognized by the shoppers so as to precipitate a substantial enlargement of sales of a product than would otherwise occur. They also accommodate facile exchange of advertising while the assembly is mounted to a store molding. They allow temporary deflections out of the orthogonal or neutral position due to an external force.

Figure 1:
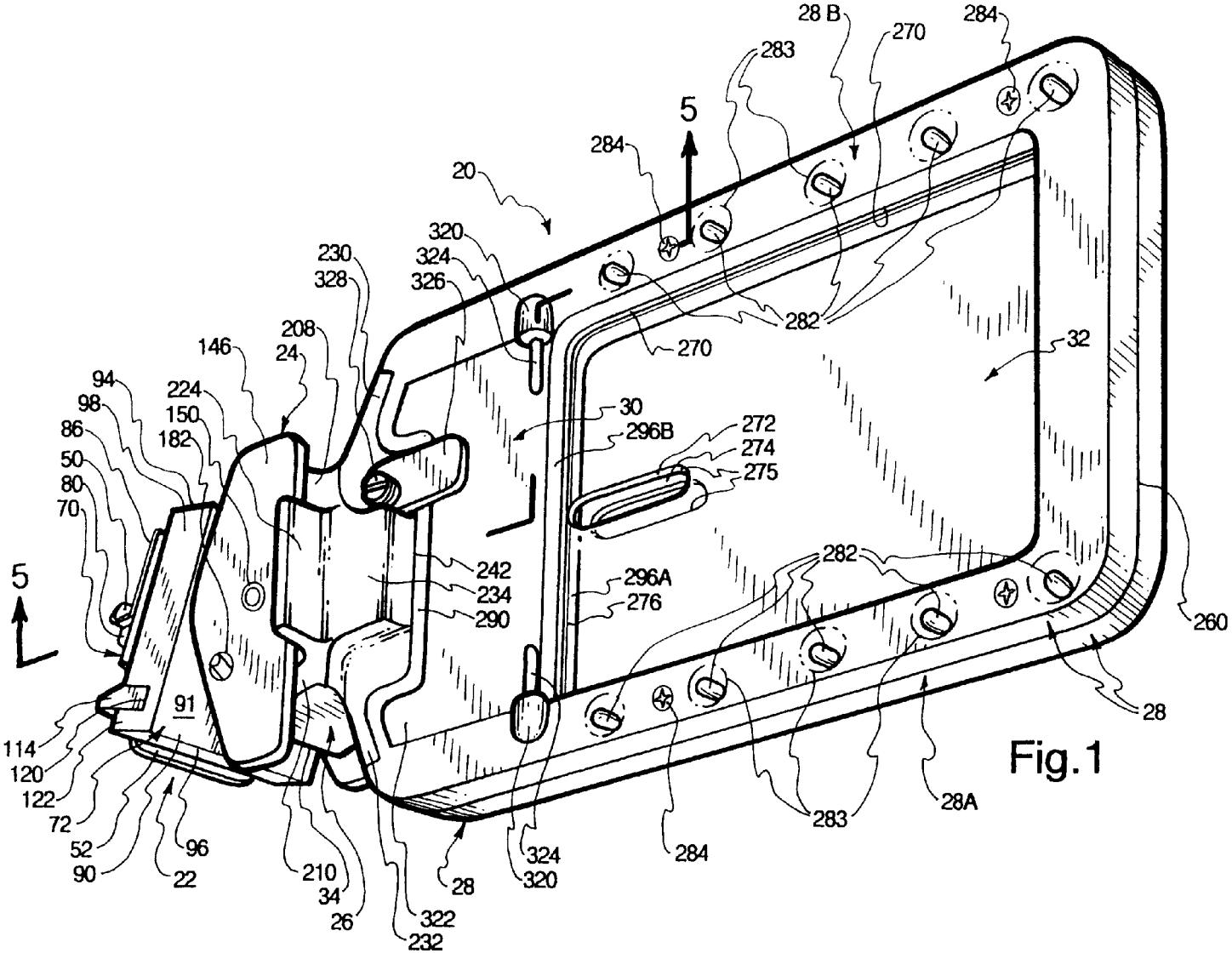
FIG. 1 is a perspective of one display assembly configuration embodying the present invention.

With reference to FIG. 1, a cantilevered, deflectable display assembly, generally designated 20, is illustrated. Assembly 20 is comprised of two proximal mounting members, generally designated 22 and 24. Other than an adjustment feature accommodating control of the angle of presentation of the display assembly (such as in a horizontally-disposed orientation), the proximal clamp member 22 and the base member 24 do not rotate or deflect when the distal region of the display assembly 20 is impacted by or receives an external force from a shopper, shopping cart or in some other way.

The display assembly 20 further comprises a distal segment or distal members comprising a hanger, generally designated 26, and a frame, generally designated 28. The frame 28 carries advertising and is peripheral in its makeup. It also comprises an access door, generally designated 30, for purposes yet to be explained and a bi-directional advertising area, generally designated 32 comprised of oppositely directed viewing windows, one on each side so that shoppers moving along the aisle in either direction have an unobstructed view along a shopping aisle of the advertising placed in the area 32.

Figure 3:
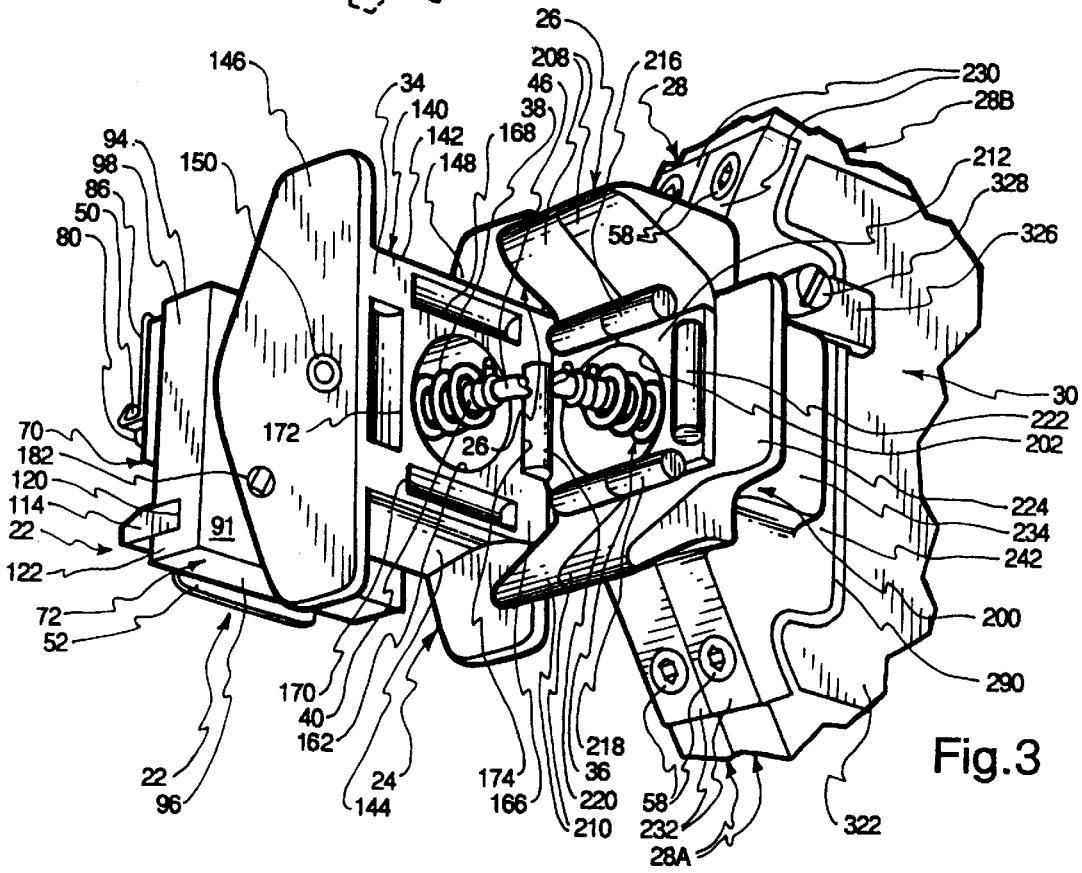
FIG. 3 is an enlarged fragmentary perspective illustrating the distal part pivoted laterally in one direction in respect to a proximal part as well as a return mechanism.
Figure 5:
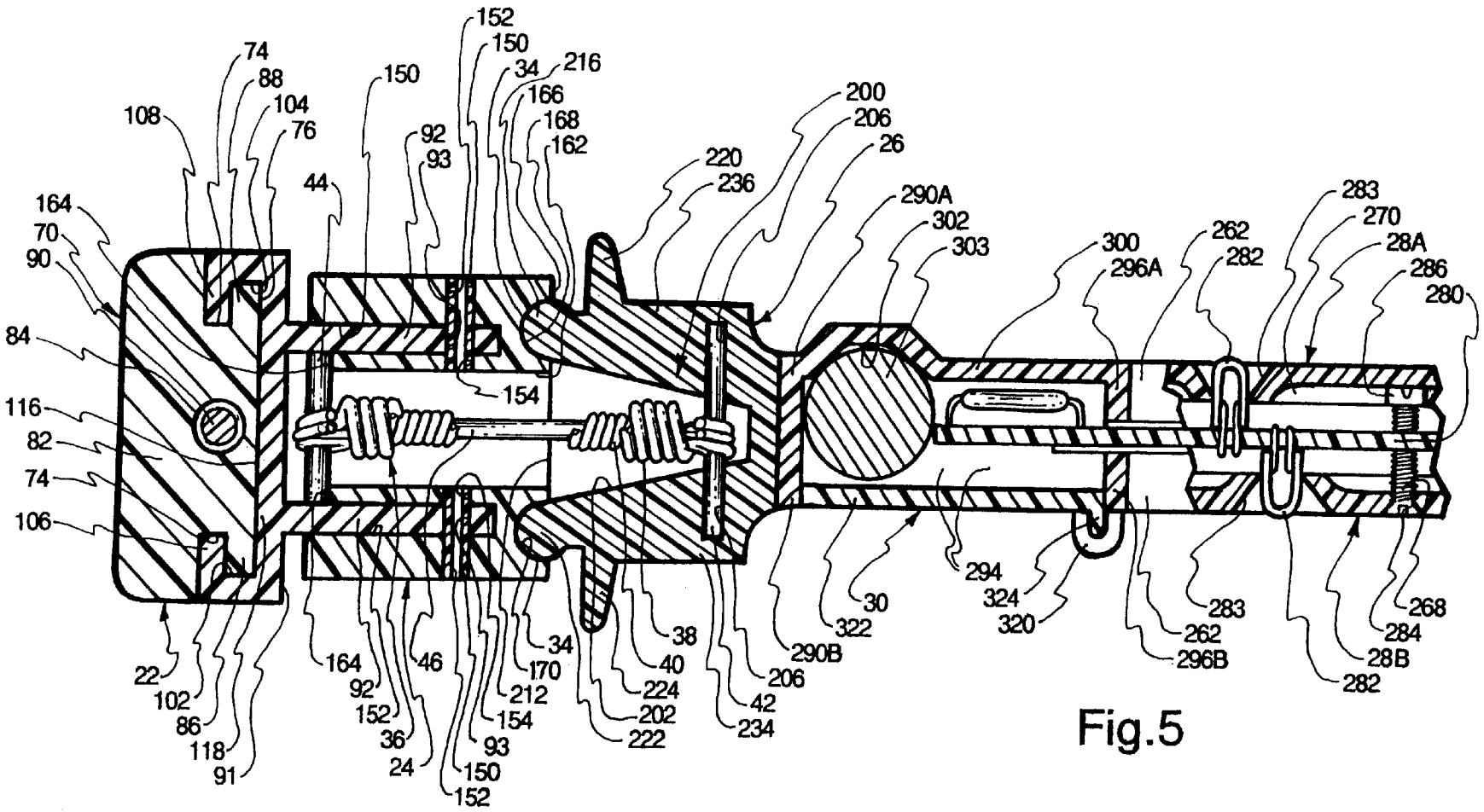
FIG. 5 is a cross section taken along lines 5—5 of FIG. 1.

The base 24 and the hanger 26, while contiguous with each other are not per se directly fastened together. To the contrary, an unattached interface 34 exists between the base 24 and the hanger 26, which accommodates collective pivoting of the hanger 26 and the peripheral frame 28 in respect to the base 24. The interface 34, therefore, does not per se provide a direct connection between the base 24 and the hanger 26 but rather the interface 34 is constantly under compression by reason of a return mechanism, generally designated 36 (FIGS. 3 and 5). The hanger 26 and the peripheral frame 28 give in the direction of impact by a shopping cart, for example, counter in part to the compression of the return mechanism 36. The return mechanism restores the hanger 26 and the frame 28 to their normal perpendicular condition into the aisle when the external shopping cart force is removed. Note that the return mechanism 36 is illustrated as being comprised of two concentric though oppositely wound coil springs 38 and 40, each connected at a hook end to a rod 42 at one end and a cross bar or rod 44 at the other end so as to be in tension to thereby place the base 24 and the hanger 26 in compression at interface 34. A stabilizing strap 46 passes through the hollow center of the inside coil spring 40 and likewise connects to rod 42 and cross bar 44 at opposite end loops of the strap 46. The return mechanism 36 is illustrated in exploded perspective in FIG. 6. Thus, the return mechanism does not attach directly to the frame 28 nor to the clamp 22 and the full weight of the pivotable portions 26 and 28 is not carried exclusively by the return mechanism 36 but rather is transferred in part across interface 34 and thence across the base 24 to the clamping member 22. Because of the manner of load and weight transfer, the useful life of the return mechanism 36 is very long. The clamping member 22 is comprised of upwardly and downwardly directed flanges 50 and 52, which may be formed of steel plate material, for retained connection to a molding or channel 54, which may be formed of a suitable metal and is anchored at abutment 56. Abutment 56 may comprise the end of a shelf or the face of a refrigerator cabinet or some other location along a shopping aisle of a grocery or other store.

It is an important feature of the present invention to provide a display assembly or mechanism for point-of-purchase utilization along a shopping aisle such that the advertising presented by the display assembly can be materially altered in its nature, configuration, peripheral makeup and content from time to time, as desired by the manufacturer of products subject to the advertising and/or store management.

Figure 10:
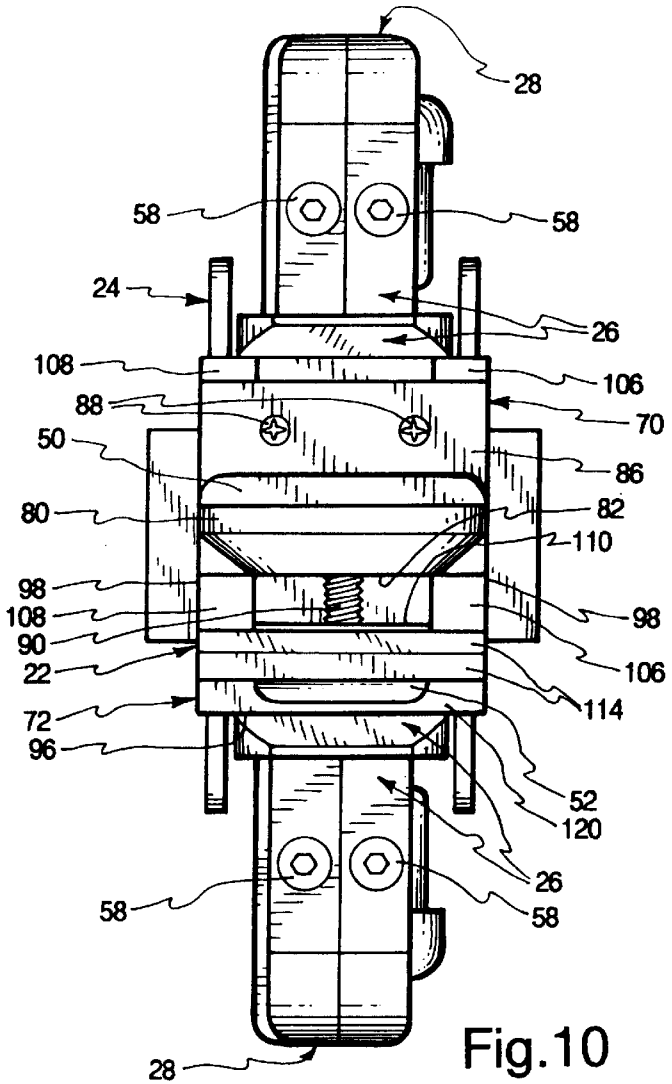
FIG. 10 is a rear elevation view of the proximal clamp of the display assembly of FIG. 1.

In respect to display assembly 20, the hanger or hanger frame member 26 releasibly or removably attaches to the peripheral frame 28 using, in the illustrated embodiment, four countersunk screws 58. See FIGS. 3, 6 and 10. Accordingly, with the display assembly 20 mounted to the store molding 54 at clamp or clip flanges 50 and 52, in the manner mentioned above, removal of fasteners 58 will disconnect the peripheral frame 28 from the hanger 26 for unitary removal and replacement. See FIG. 8. Thereafter, a similar, or, if desired, a substantially different advertising end for the display assembly may be connected to the hanger 26, including but not limited to such as the bottle configuration generally designated 60 in FIG. 7. Thus, display assemblies of the present invention accommodate substantial variation in the nature, the configuration, including the peripheral make-up, and the content of the advertising segment of a display assembly without requiring disconnection and removal of the entire display assembly from its mounting upon a molding at a shelf edge or on the face of a refrigerator cabinet. Virtually any advertising configuration can be removed from or connected to the hanger 26 to provide essentially an infinite number of on-site possibilities, none of which require that the display assembly be disconnected from its mounting to the store-provided molding 54. Thus, the hanger 26 accommodates facile on-site frame and advertisement removal, while the remainder of the display assembly remains in its shelf-mounted or like position in the store.

The clamping member 22 is comprised of sliding and fixed parts in the form of a slider 70 and a stationary receptor 72. The slider 70 comprises oppositely directed grooves 74, a flat back surface 76, and a front surface 78, which is stepped or enlarged at shoulder 80. Between the front surface 78 and the back surface 76, the slider 70 comprises a body 82 in which a metal sleeve 84 is generally vertically disposed. The slider 70 is of general block configuration and comprises opposed flanges 86 and 88, which respectively partially define vertical slots 72 at each side of the slider 70. The slider 70 and the receptor 72 may be formed of any suitable material, including synthetic resinous material such as ABS.

Figure 8:
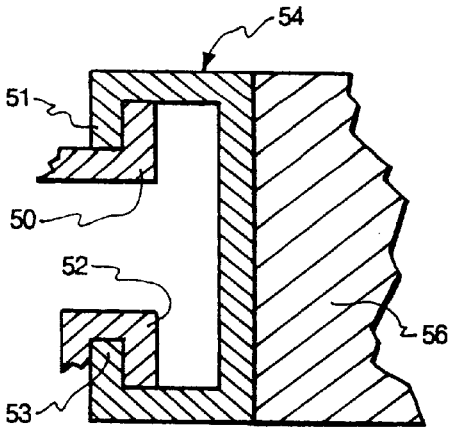
FIG. 8 is a fragmentary vertical cross section showing the way the flanges of the proximal clamp of the display assembly of FIG. 1 is secured to a molding in a retail store.
Figure 9:
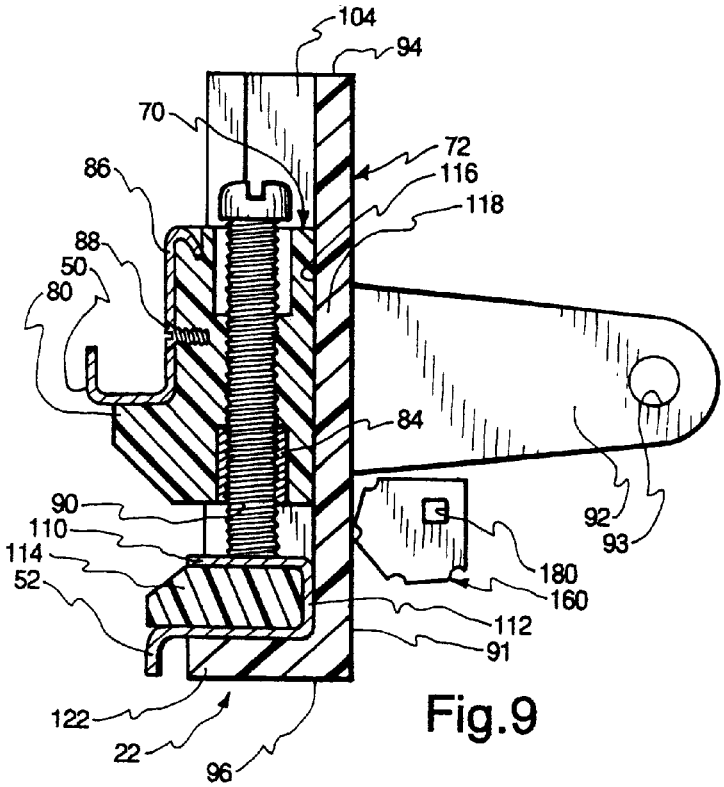
FIG. 9 is a vertical section through the proximal clamp of the display assembly of FIG. 1.

The flange 50 is part of a z-shaped metal plate 86, the shape of which is best illustrated in FIG. 9. The z-shaped plate 86 is rigidly connected to the slider 70 by two countersunk screw fasteners 88. The out-to-out width of the slider 70 is essentially the same as the out-to-out width of the receptor 72. When assembled, a screw 90 is threaded through the sleeve 84, to engage the receptor 72, in a manner hereinafter explained, to adjust the space between the flanges 50 and 52 to accommodate an interlocking engagement with the store molding 54, as illustrated in FIG. 8.

The receptor 72 comprises an essentially rectangular body 89 comprised of a distal surface 91 from which two spaced, parallel lugs or anchors 92 extend. See FIG. 6. Lugs 92 are formed as one piece with the remainder of the receptor 72 and each comprises a distal aperture 93 by which the clamping member 22 is connected, for very limited rotation, to the base member 24, as hereinafter more fully explained. The receptor 72 comprises a top flat surface 94, a parallel bottom surface 96 and opposed side surfaces 98 and 100.

The proximal side of the receptor 72 defines opposed vertically-directed slots 102 and 104 formed in part by parallel inwardly directed flanges 106 and 108, respectively. See FIG. 5. The grooves 102 and 104 are sized and arranged to snugly but slidably receive the flanges 86 and 88 of the slider 70, while the flanges 106 and 108 of the receptor 72 respectively fit within opposed slots 74 of the slider 70, as shown best in FIG. 5. When assembled, the slider 70 may be vertically forcibly displaced up or down in respect to the receptor 72 by rotation of screw 90 in sleeve 84.

By reducing the distance between clamp flanges 50 and 52, these flanges 50 and 52 are placed within the opening between molding flanges 51 and 53 of shelf or like molding 54. See FIG. 8. Once the constricted flanges 50 and 52 of the clamping member 22 have been placed inside of molding flanges 51 and 53, flanges 50 and 52 are expanded by rotation of screw 90 in sleeve 84, which vertically lifts the slider 70 upwardly, in respect to the receptor 72. This process continues until the clamping flanges 50 and 52 securedly engage molding flanges 51 and 53, as shown in FIG. 8. A screwdriver is the only tool necessary to so clamp the clamping member 22 to the molding 54 to securely retain the display assembly 20 in its cantilevered deflectable position extending orthogonally into a shopping aisle.

The flange 52 forms a part of a circuitously-shaped plate 110, the width of which is less than the out-to-out width of receptor 72. See FIGS. 9 and 10. The plate 110 comprises a U-shaped portion 112 into which a block 114 of synthetic resinous material plastic is snugly fitted, as shown in FIG. 9. The block 114 is enlarged at its opposing ends so as to be contiguous with the surfaces 116 at grooves 120 of wall 118, where the two are secured to each other using a suitable adhesive, bonding agent, ultrasonic welding or the like. In this way, the block 114 and the plate 110 are held fixedly in the assembled position as an integral part of the receptor 72. Specifically, the flanges 106 and 108 are slotted on each side at grooves 120 to snugly receive the retaining block 114. It is at these locations that the block 114 is adhered to the receptor 72.

As best shown in FIG. 9, the threaded end of the screw 90 engages the top portion of the plate 110 to create a bearing relationship for lifting and lowering the slider 70 in respect to the receptor 72 responsive to appropriate rotation of the screw 70 within the sleeve 84 and against the upper surface of the plate 110.

It is preferred that the slider 70 and the receptor 72 be each formed as one piece using conventional molding techniques, although each could be formed of multiple pieces cemented, bonded or welded together as deemed appropriate by those skilled in the art. It is appreciated that the receptor 72 comprises a horizontally-directed base wall or layer 122, upon which the flanges 106 and 108 rest and of which bottom surface 96 forms a part.

The base or base member 24 may be formed of suitable synthetic resinous material such as ABS, either as one piece or as a plurality of pieces which are adhered, bonded or welded to each other to integrate the base 24. The base 24 comprises a central main body portion 140 which comprises top and bottom undulating surfaces 142 and 144, respectively. See FIG. 3. Top and bottom surfaces 142 and 144, respectively function as stops to limit the extent to which the hanger 26 may be pivoted or displaced up and down. The illustrated limits on up and down displacement are illustrated in dotted lines in FIG. 4.

The base 24 comprises arrow-shaped side flanges 146 and 148, respectively, which extend above and below surfaces 142 and 144 but otherwise comprise dimensions congruent with the side dimensions of the central body 140. Side flanges 146 and 148 serve as stops, limiting the extent to which the hanger 26 can be pivoted laterally in either direction, as shown in dotted lines in FIG. 2. Side flanges 46 and 48 also function as shields or guards to enhance the safety of the mechanism when the hanger 26 is pivoted in respect to the base 24.

The central body 140 comprises two spaced proximal slots 150 and 152 (FIG. 5) into which anchors or ears 92 fit. The ears 92 are secured pivotably to the base 24 by a tube 150 on each side which passes through the associated lug aperture 93 and through adjacent apertures 152 and 154 in the adjacent flange 146, 148 and the central body portion 140, respectively.

The slots 150 and 152 also each receive a leveling or angle of presentation cam 160, for purposes yet to be explained.

The central body portion 140 comprises an axial, large diameter centrally located through-bore 162 in which the return mechanism 36 is spacedly and centrally positioned in tension. Rod 44, to which the strap 46, the inner spring 40 and the outer spring 38 is secured at the respective proximal looped ends thereof spans transversely across the proximal part of the central bore 162 into oppositely-located blind bores in base 24 and against interfaces 164. See FIG. 5.

As mentioned earlier, the distal surface of the central body 140 at interface 34 defines the pivotable relationships between the base 24 and the hanger 26. Specifically, central body 140 comprises a flat vertical distal surface 166. See FIG. 3. Recessed in surface 166 are four semi-cylindrical indentations, i.e. a top, horizontally-disposed semi-cylindrical indentation 168, a bottom semi-cylindrical horizontally-directed semi-cylindrical recess 170, a first vertically-disposed semi-cylindrical recess 172 and a second vertically disposed semi-cylindrical recess 172. In short, top recess 168 accommodates pivoting of the hanger 26 in an upward direction, recess 170 accommodates pivoting of the hanger 26 in a downward direction, recess 172 accommodates lateral displacement of the sign in one direction and recess 174 accommodates lateral displacement of the hanger 26 in the other lateral direction.

Figure 2:
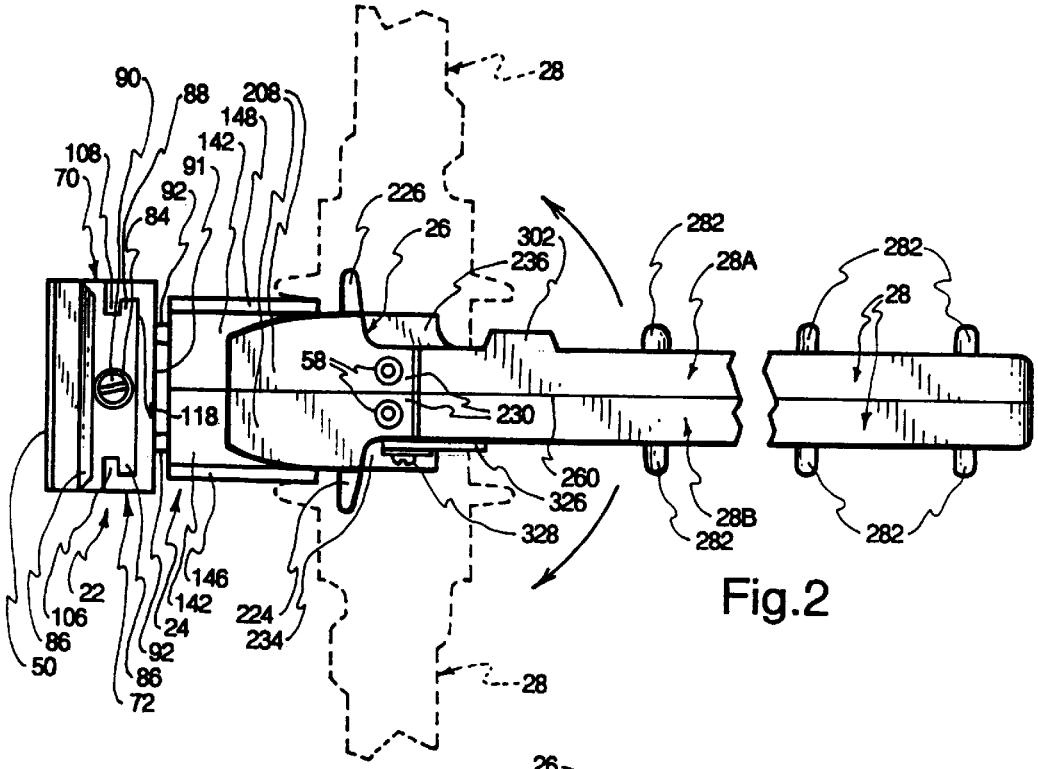
FIG. 2 is a plan view of the display assembly of FIG. 1, showing in dotted lines the lateral or side-to-side range of deflectibility or displacement of the pivotable distal part of the assembly.
Figure 4:
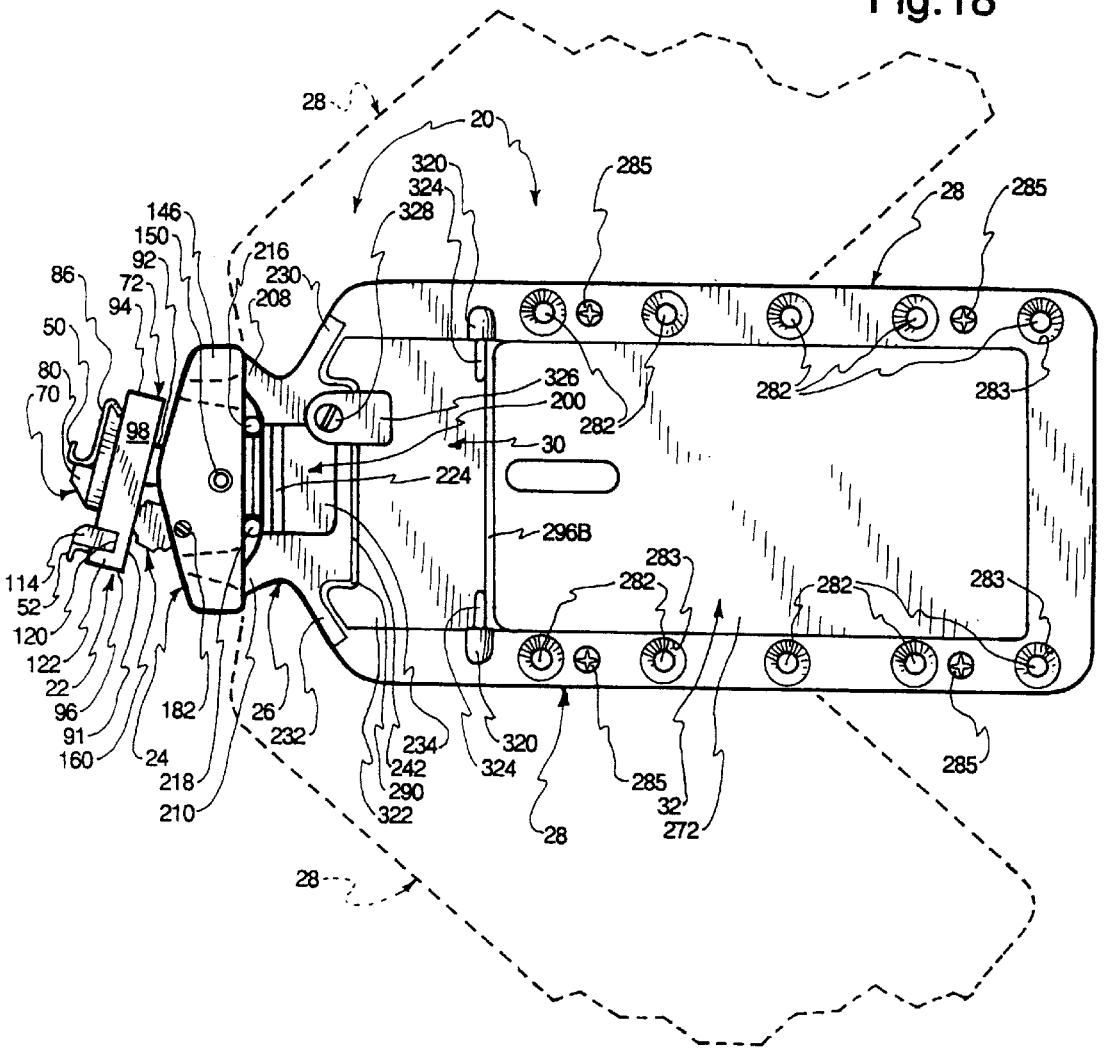
FIG. 4 is a side elevation of the display assembly of FIG. 1, showing in dotted lines the up and down range of deflectibility or displayment of the pivotable distal part of the assembly.

From the foregoing, it is clear that semi-cylindrical recesses 168, 170, 172 and 174 assist in defining four axes of rotation by which the hanger 26 and the advertising frame 28 pivot up and down, as illustrated in dotted lines in FIG. 4 and laterally in either direction as illustrated in dotted lines in FIG. 2.

Figure 11:
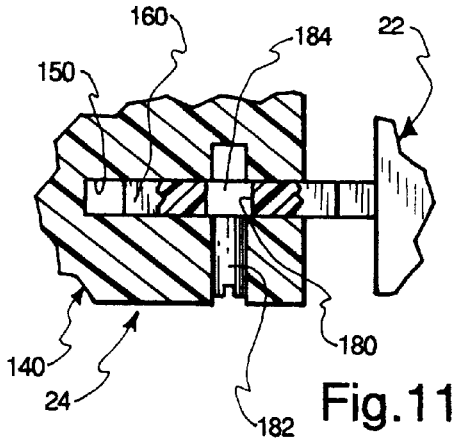
FIG. 11 is a fragmentary enlarged cross section of one of two cams carried by a base member so as to contiguously engage the clamp, rotation of cams accommodating adjustment in the angle of presentation of the display assembly.

As mentioned briefly above, slots 150 and 152 of the base 24 not only respectively receive the anchors 92 of the clamping member 22, but at a lower location receive, respectively, a leveling or angle of presentation adjustment cam 160. Each of the two spaced leveling cams 160, best illustrated in FIGS. 6 and 9, comprise a rectangular or square aperture 180 located near one coner of the cam 160. A shaft 182, which is circular in cross section at its ends and rectangular or square at its center secures each cam 160 in its assembled position for limited rotation with the associated pin 182 about the axis of the associated pin 182. As shown in FIG. 11, the ends of the pin or shaft 182 are rotatably held in bores in the body 140 of base 24, with the central portion 184 (the square or rectangular portion) non-rotatably positioned in the square or rectangular aperture 180 of the associated cam 160.

The periphery of each cam 160 primarily comprises a series of differently spaced peripheral camming surfaces each interrupted by U-shaped comers such that the weight of the cantilevered portion of the display assembly 20 imposes a moment or rotating force bringing the cam surface which is directly adjacent the clamping portion 22 into contact with the distal surface 91 of the receptor 72 of the clamping portion 22. Each peripheral surface is spaced a different, predetermined distance from the axis of rotation of shaft 182. By using a correctly sized screwdriver, the circular portions of the shaft 182 may be selectively rotated for both cams so that the cam surface with which the receptor surface 91 is contiguous is changed thereby altering the collective angle of presentation of the base 24, the hanger 26, and the advertising frame 28 of the display assembly 20. This angle of presentation may be horizontal and, therefore, the rotation of the two cams 160 may be for purposes of leveling the display assembly. On the other hand, if it is desired to have the cantilevered portion of the display assembly at an angle to the horizontal, correct adjustment of the cams 160, in the manner described above, will accommodate any one of several angles of presentation. It is to be appreciated that the cams 160 are contiguous with the lower portion of surface 91 thereby accommodating a limited amount of pivotal motion of the base 24 in respect to the fixed location of the clamp 22 to the extent such may be accommodated by the available rotation of cams 160.

Figure 6:
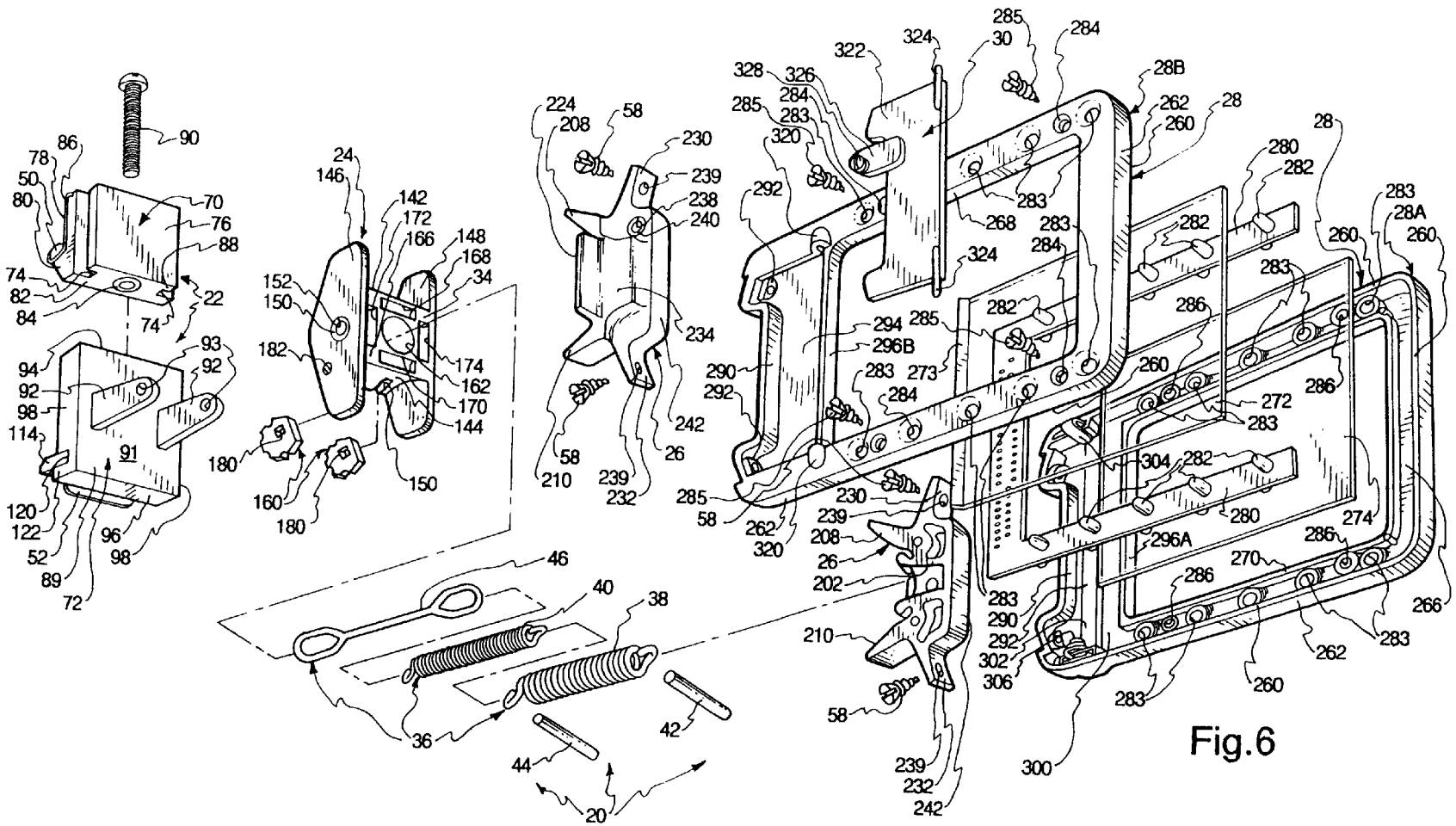
FIG. 6 is an exploded perspective of the display assembly of FIG. 1.

The hanger 26 is illustrated in FIG. 6 as being comprised of two identical or substantially identical opposite hand pieces which are, following conventional molding, glued, bonded or welded together so as to form an integrated part. In the alternative, the hanger 26 may be formed as a single piece through known injection molding techniques. On the other hand, if more convenient, hanger 26 may be formed of more than two parts which are thereafter adhered into an integrated element of the display assembly 20. Any suitable synthetic resinous material may be used to form hanger 26, such as ABS plastic. Before explaining in detail the structural and functional makeup of the hanger 26, it should be pointed out that pivoting of the display assembly 20 is accommodated by rotational displacement of the hanger 26 in respect to the base 24 at the interface 34.

Figure 7:
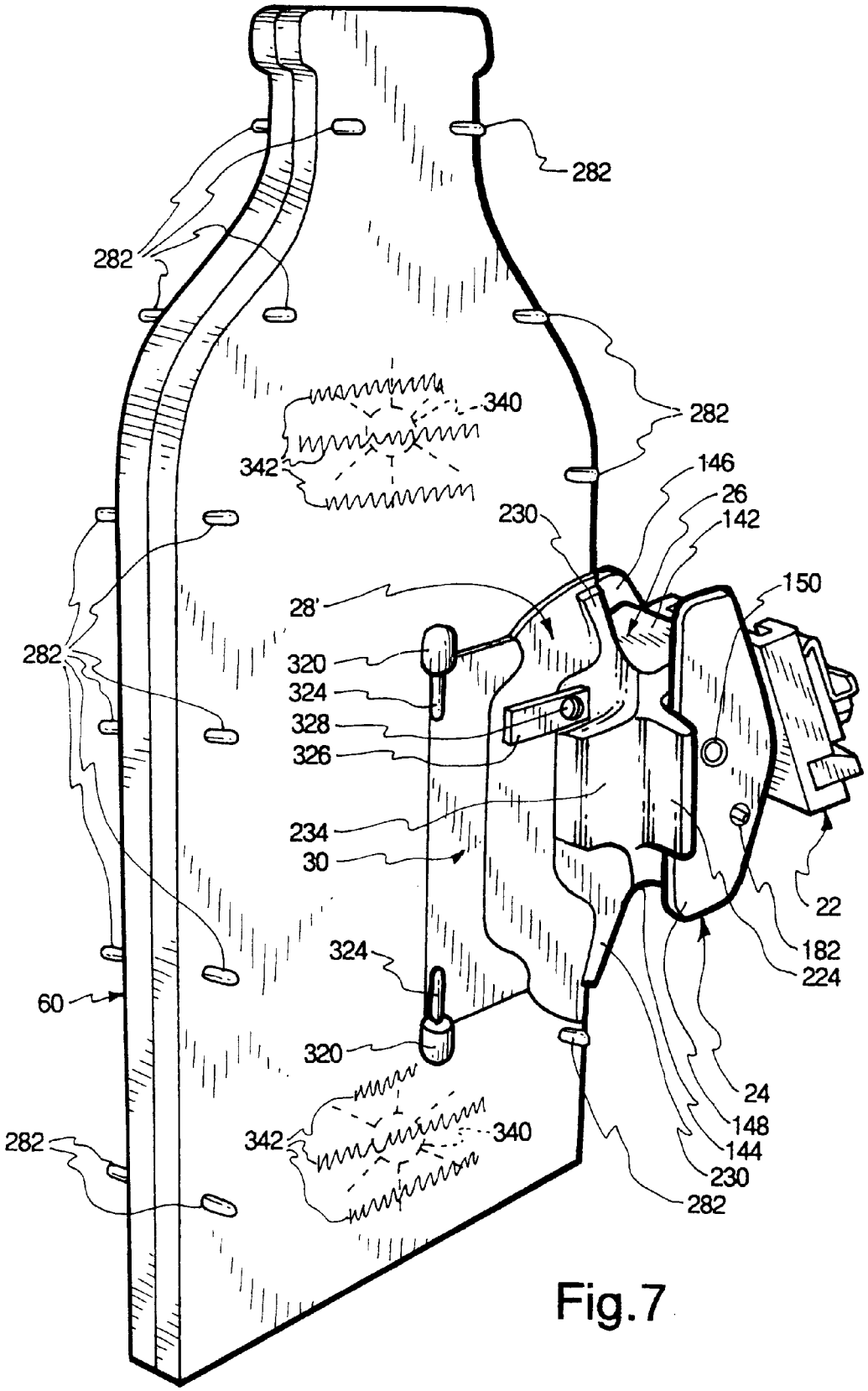
FIG. 7 illustrates in perspective a replacement distal advertising segment in the form of a bottle substituted for the frame and advertising segment of FIG. 1.

On the other hand, the hanger 26 serves to removably connect with the advertising-carrying frame 28 thereby allowing for replacement of the frame 28, with its advertising, by a similar or dissimilar advertising segment, such as the bottle illustrated in FIG. 7. The hanger 26 comprises a central body 200, the proximal interior of which defines a frusto-conical recess or blind bore 202, across which, toward the distal blind end of the frusto-conical recess 202 spans a rod 42. The opposite ends of the rod 42 extend into oppositely-located blind bores 206 in the main body 200. See FIG. 5. The distal eyelet ends of the strap 46, the coil spring 40 and the coil spring 38 loop around and are secured to the rod 42 so that the springs 40 and 38 are placed in tension, thereby compressively causing the hanger 26 to forcibly engage the base 24 at recesses 168, 170, 172 and 174.

Extending distally are top and bottom wedge-shaped stops 208 and 210, respectively. The under surface of wedge-shaped stop 208 and the upper surface of wedge-shaped stop 210 each have an undulating configuration shown to be selected to match or substantially match the undulating configuration of top surface 142 and bottom surface 144, respectively, of the base 24. When the distal portion of the display assembly 20 is displaced, for example by a shopper or a shopping card in an upward direction, the magnitude of upward displacement is limited by engagement between the bottom surface of stop 208 and surface 142. This displacement is shown in the upper portion of FIG. 4 in dotted lines. This displacement is accommodated by semi-cylindrical recess 168.

Similarly, when an external force displaces the distal part of the display assembly 20 in a downward direction, the magnitude of such displacement is limited by contiguous engagement of the upper surface of the stop 210 against surface 144. The magnitude of this available displacement is illustrated in dotted lines toward the bottom of FIG. 4.

Between the wedge-shaped stops 208 and 210 which extend proximally, are disposed, adjacent vertical surface 212 four cylindrically-shaped rotation-accommodating solid cylinders 214, 216, 218 and 220, which collectively arranged in a rectangular or square pattern. Cylinders 216 and 218 extend horizontally and are spaced from each other a predetermined distance to accommodate a nesting, contiguous relationship within semi-cylindrical recesses 168 and 170, respectively, of the base 24. Similarly, vertically-directed solid cylinders 220 and 222 are spaced so as to nest within recesses 174 and 172, respectively. The cylinders 216, 218, 220 and 222 in conjunction with recess 168,170, 172 and 174 accommodate upward displacement of the hanger 26, downward displacement of the hanger 26, lateral deflection of the hanger 26 in one direction and lateral displacement of the hanger 26 in the other direction, respectively. These displacements are shown in dotted lines in FIGS. 2 and 4. Thus, the base, at is face, pivotably interfaces uniquely and compressively with the hanger to enhance the deflectable nature of the cantilevered part such that the weight and external loads imposed upon the return mechanism are greatly reduced, thereby enhancing the life of the return mechanism. The return mechanism accommodates up, down and bi-lateral displacement responsive to an external force and returns the distal part of the display assembly to the neutral position when the external force is removed.

Thus, the center line of the cylinders 216, 218, 220 and 222 comprise axes of rotation for the four forms of displacement mentioned above. As shown in FIG. 3, the hanger 26 is illustrated as having been rotated through essentially 90 degrees about the axis of the cylinder 220, the cylinder 220 remaining nested in the semi-cylindrical recess 174 to accommodate such rotation. The main body 200 of hanger 26 comprises opposed side flanges 224 and 226. Flanges 224 and 226 respectively function as stops by engagement with the exterior surface of flanges 146 and 148, respectively, to limit lateral displacement in either direction to essentially 90 degrees. See the dotted line positions in FIG. 2. In the neutral orthogonal position, the flanges 224 and 226 extend oppositely parallel to the shopping aisle.

The body 200 of the hanger 26 comprises a bifurcated configuration comprising top and bottom flanges 230 and 232 by which the frame 28 is removably or releasibly connected, using countersunk fasteners 58. The distal end of the hanger 26 comprises flat reinforcing regions 234 and 236, respectively. Above the reinforcing wall 234 only is a blind bore 238 into which a threaded sleeve 240 is inserted to accommodate locking of the access door as explained hereinafter in greater detail. See FIG. 6.

Each countersunk screw 58 passes through an aperture 239 in associated flange 230 or 232, as the case may be. The upper and lower flanges 230 and 232 centrally merge into the central body 200, which, among other things, projects distally so the distal face 242 matches the proximal configuration of the frame 28 in a contiguous load-transferring manner. Thus, a substantial portion of the weight of the frame 28 and the advertising carried by the frame is transferred across 242 as are impact loads.

Figure 18:
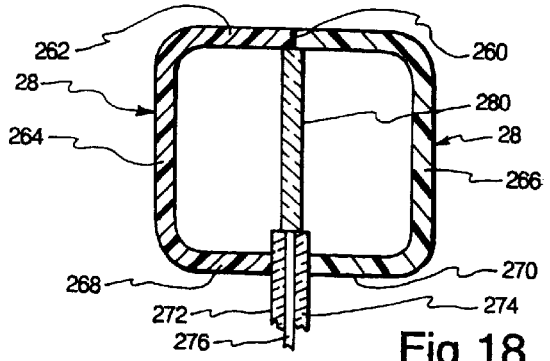
FIG. 18 is an enlarged fragmentary cross section of the peripheral frame, opposed shields for two viewing windows and advertising disposed between the shields.

While illumination is not essential to certain aspects of the present invention, illumination is preferred. As best seen in FIG. 6, the frame 28 is comprised of similar halves 28A and 28B, which are held together to form a central juncture in a vertical plane comprising contiguous inside edges 260 by fasteners 284. When assembled, the top, bottom and distal peripheral portions of the frame 28 have identical cross sections, except for countersunk fastener holes and apertures 283 through which lights 282 extend, as hereinafter more fully explained. The cross section of the united frame is illustrated in FIG. 18. Accordingly, when joined together, the frame comprises a peripheral wall 262, two spaced side walls 264 and 266, which respectively connect to inwardly directed short flanges 268 and 270 which define a gap there-between. This gap comprises a slot between the inwardly directed flanges 268 and 270 along the top, distal and bottom of the frame into which opposed transparent shields 272 and 274 are inserted with an advertising sheet or card 276 interposed between the transparent planar shields 272 and 274. Shields may be of glass or polycarbonate material. A U-shaped circuit board 280 (FIG. 6) with lights 282 carried thereon, each in a countersunk aperture 283, is positioned in the hollow interior between walls 264 and 266 so as to extend within the frame 28 along the top, the bottom and the proximal region of the frame. Shields 272 and 274 may comprise a slot through which an advertising sheet or card may be manipulated. Note that the shield 272 comprises a proximal, angularly-disposed lip 273. See FIGS. 6 and 12.

The circuit board is illustrated as comprising twenty lights (10 on each side) which preferably comprise light-emitting diodes (LEDs). Other sources of illumination may be used. Each LED 282 extends through an aligned aperture 283 in the frame 28. The frame 28 may be formed of any suitable material such as ABS synthetic resinous material. In addition to or in lieu of adhering the edges 260 of the two frame parts together, four countersunk screws 285 may be relied upon for fastening frame parts 28A and 28B together. Screws 285 extend through apertures 284 in the frame part 28B so as to threadedly engage an opposed interior boss 286 of frame part 28A. It is to be appreciated that the circuit board 280 comprises conductors which appropriately supply electrical power along the circuit board to each of the lights 282.

The proximal end of the frame 28, in its assembled and united form, comprises a circuitous wall 290, which merges with the top and bottom peripheral frame portions, is illustrated as being of uniform thickness and conforms with the shape of the distal edge of the hanger 26 so that the two are contiguous when in the assembled condition. See FIG. 6. Wall 290, near the top and bottom, respectively, comprises sets of threaded bosses 292, each of which threadedly receives a threaded end of one of the screws 58 to removably attach the hanger 26 to the frame 28.

Immediately distal of wall 290 is a compartment 294, which spans through both parts 28A and 28B of the frame 28. Compartment 294 is a multi-purpose compartment into which batteries are placed, in which the base of the circuit board 280 is housed and comprises an access region for insertion removal of advertising information on a sheet or a card as explained herein in greater detail. The distal end of the compartment 294 is defined by two spaced vertical wall 296A and 296B which runs between the top and bottom portions of the peripheral frame. Walls 296A and 296B also defines the proximal beginning of opposed windows, also formed by flanges 268 and 270. Through these two window areas, an advertising sheet or card 276 is inserted and visually seen through transparent shields 272 and 274, respectively.

Figure 16:
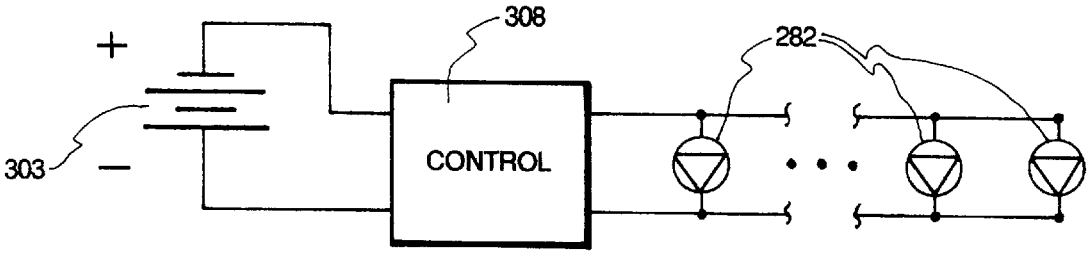
FIGS. 16 and 17 are circuit diagrams which may be used to illuminate the display assembly.
Figure 17:
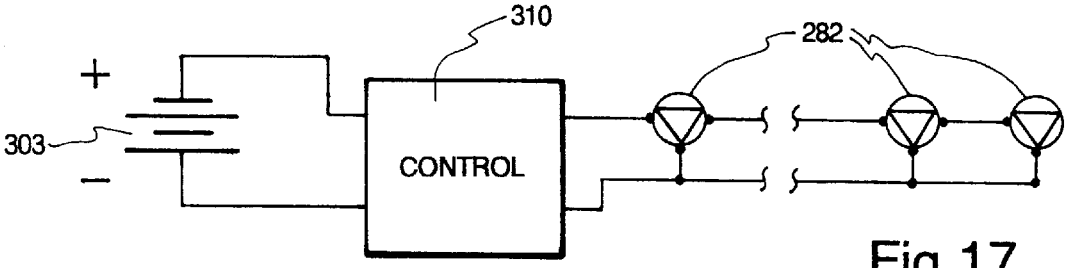

The one part 28A of the frame 28 defines a back wall 300 to the compartment 295, which has a recessed wall plate component 302 into which two low voltage batteries 303, preferably triple A size, are fitted in series between upper electrical conductor 304 and lower spring conductor 306. The conductors 304 and 306 electrically connect either directly or through a control 308 or 310 (see FIGS. 16 and 17) to the lights 282 in parallel and, respectively, in series or in any other fashion consistent with the practices within the skill of the art. Control 308 and/or 310 can be any form of control by which selective illumination of the LEDs 282 is accomplished, including fixed illumination, pulsated illumination, sequential illumination, etc. The batteries 303 stay in place within compartment 294 with the access door 30 closed.

Figure 12:
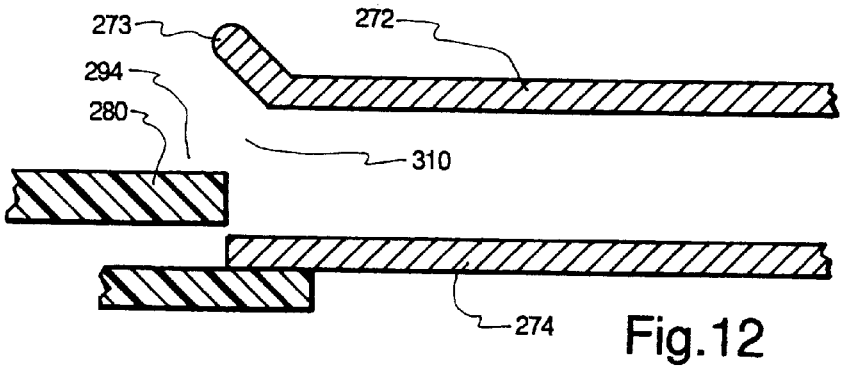
FIG. 12 is a fragmentary cross section illustrating an internal slot by which an advertising placard with or without a plastic carrier is securely placed within the frame of the display assembly.

The trailing base or proximal portion of the circuit board 280, the straight proximal end of the shield 278 and the angular proximal end 273 of shield 272 extend a short distance into the compartment 294. Accordingly, as illustrated in FIG. 12, a vertical slot 310 exists between angular wall 273 of shield 272 and the base of circuit board 280 through which an advertising card or two either alone or in a carrier can be inserted between the shields 272 and 274.

Figure 13:
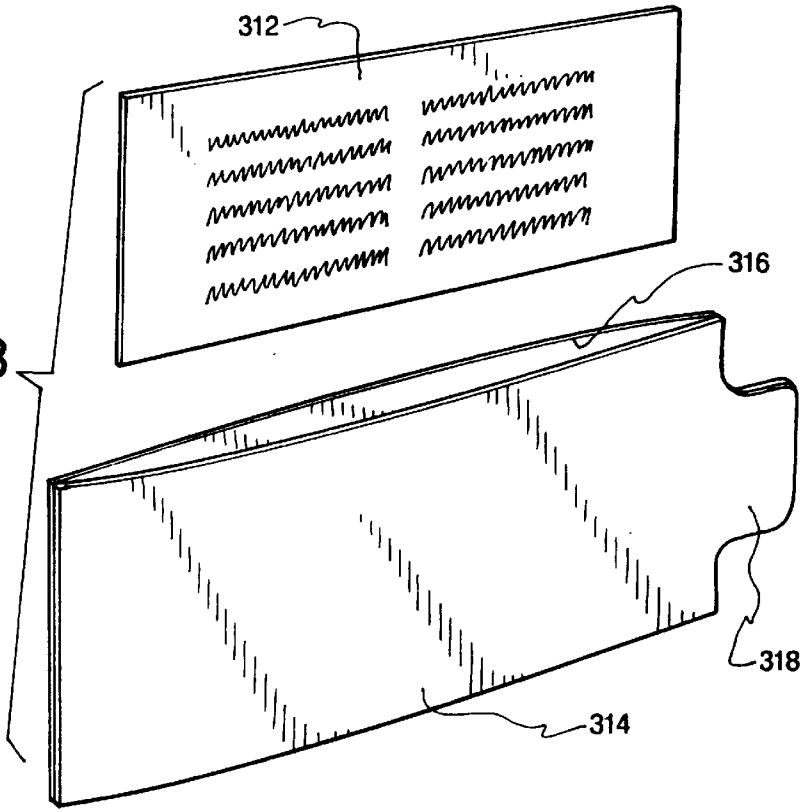
FIG. 13 is an exploded perspective of a transparent plastic carrier in which an advertising card is placed and the combination inserted into the frame of the display assembly.

In reference to FIG. 13, planar advertising 312 in the form of a rectangular card with advertising information on both sides may be inserted into a transparent plastic carrier 314 through a top opening 316. The card 312 and carrier 314 may be collectively considered as being planar advertising. Two advertising cards, with oppositely directed advertising information, may be likewise inserted into the carrier 314. The two sides and bottom of the transparent advertising carrier 314 are illustrated as being closed. One end of the carrier 314 comprises an axially-extending proximal tab 318, which can be manually grasped to assist in stabilizing the carrier 314 when the advertising card 312 is placed therein or removed therefrom and to manipulate the card carrying carrier 314 through the slot 310 into and from the space between the shields 272 and 274. See FIG. 12. Carrier 314 enhances insertion, retention and removal from the peripheral frame of advertising cards and reduces wear and tear, soiling, vandalism and unauthorized removal.

The frame side 28B comprises top and bottom blind bore anchors 320, which are identical though of opposite hand. The access door 30 comprises a flat plate 322, the configuration of which matches the shape of the compartment 294. The plate 322 has attached thereto near the distal edge a pair of oppositely-directed pivot shafts 324, which are rotatably received in the blind bores of the top and bottom anchors 320. Thus, access door 30, in its assembled condition, may be rotated between a closed position and an open position permitting access to compartment 294. The access door 30 also comprises a latch bar 326, which extends in a proximal direction offset from but parallel to the axis of the frame 28. Carried at the distal end of the flange 326 is a spring-biased locking screw 328, sized, shaped and positioned to be in alignment with the threaded sleeve 240 carried by the hanger 26. By placing a screwdriver in the slot of the fastener 328, applying force and rotating, the screw 320 becomes threadedly secured in sleeve 240 to releasibly hold the access door 30 in the closed position. When access through the door 30 is desired, the screw 328 is oppositely rotated by the screwdriver and the door 30 pivoted into the open position. This accommodates access to the advertising area through slot 310 between the shields 272 and 278 and/or access to the batteries 303 serially interposed between conductors 304 and 306. Thus, for example, the batteries may be quickly replaced after the power thereof has been utilized, with the access door 30 open. When the battery replacement has occurred and/or the advertising material has been placed or replaced, the access door may be closed and locked. Since a tool is required to open the access door 30, the risk of consumer tampering or vandalism associated with the batteries and/or the advertising is substantially reduced.

Figure 14:
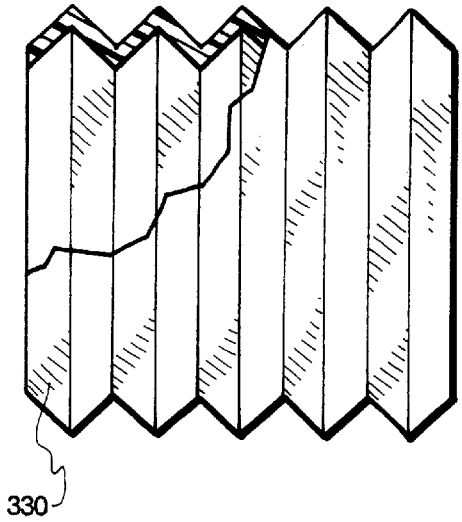
FIG. 14 is a fragmentary side elevation, shown partly in cross section, of a protective boot.
Figure 15:
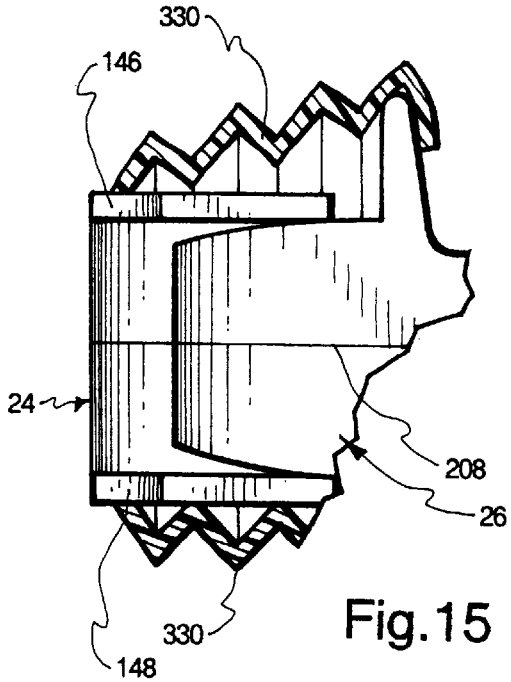
FIG. 15 is a fragmentary top view partly in cross section of the protective boot of FIG. 14 in its installed stretched position on the display assembly.

Because the return mechanism 36 comprises spring coils 38 and 40 and because the hanger 26 pivots into an open relationship in respect to the base 24, in some configurations of the present invention, an elastomeric protective boot may be placed in surrounding location over the areas which open during pivoting to prevent injury to a child or a shopper. A suitable boot 330 for this purpose is illustrated in FIG. 14. While the boot 330 is illustrated as being in bellows or pleated form, other configurations may be used. The boot 330 may be adhered at its ends to appropriate location around the periphery of the base 24 and the hanger 26. The boot may, alternatively, be stretched into its protective position. No matter how installed, the boot 330 shields the portions of the display assembly 20 which create openings when the distal pivotable portion of the assembly is pivoted in respect to the proximal non-pivoting portion of the assembly. See FIG. 15.

In respect to FIG. 7, the original or replacement advertising may take the form of a distinctive or non-distinctive bottle 60 or any other desired shape or form. It preferably comprises a self-contained illumination system comprising one or more low voltage batteries behind the access door 30, circuitry such as that depicted in FIGS. 16 and 17 and one or more LEDs 282 and/or one or more background lights 340. Advertising indicia 342, such as product identification, price, duration of any sale, etc. may appear as part of the advertising. The bottle 60 is connected to the hanger 26 at frame portion 28, which is peripheral, but does not surround the bottle as illustrated although it could.

An important feature of the present invention is to alleviate or prevent tampering with advertising display assemblies embodying certain aspects of the present invention. In addition to the anti-tampering features already described above, a further anti-tampering feature is made available by the present invention. Specifically, the proximal-to-distal axial extension available via the return mechanism 36 is less than the distal-to-proximal overlap of stops 208 and 210, respectively, over and above surfaces 140 and 142 of the base 24. Flanges 146 and 148 laterally flank stops 208 and 210 so that no significant amount of rotation of hanger 26 and frame 28 around the longitudinal axis of the assembly 20 is possible even when tension is applied to the return mechanism 36. Thus, a shopper, vandal or other person can not axially twist the hanger 26 and frame 28 to either invert the frame 28 and the advertising within the frame 28 or sever the return mechanism 36 by twisting it to remove the hanger 26 and frame 28 from the base 24.

The invention may be embodied in other specific forms without departing from the spirit of the essential characteristics thereof. The present embodiments, therefore, are to be considered in all respects as illustrative and are not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A cantilevered display assembly comprising:

a distal advertising display segment comprising a frame carrying an illumination system comprising a source of electrical power, circuiting and at least one light peripherally disposed in respect to an advertising area, the display segment further comprising a pivotable mounting hanger portion distally connected to the frame at a proximal region of the frame;

a proximal segment comprising a clamp for cantilever mounting the assembly to a molding and a base about which the mounting hanger portion and display segment may be unitarily pivoted responsive to external forces;

a return mechanism interposed between the proximal segment and the display segment;

an access door carried by the frame through which the source of electrical power is selectively inserted and removed, the access door further accommodating selective insertion of advertising into the advertising area.

2. A cantilevered display assembly according to claim 1 wherein the access door is hinged to the frame and comprises a releasible lock accommodating selective closing and opening of the access door.

3. A cantilevered display assembly comprising:

a distal advertising display segment comprising a frame carrying an illumination system comprising a source of electrical power, circuitry and at least one light peripherally disposed in respect to an advertising area, the display segment further comprising a pivotable mounting hanger portion distally connected to the frame at a proximal region of the frame;

a proximal segment comprising a clamp for cantilever mounting the assembly to a molding and a base about which the mounting hanger portion and display segment may be unitarily pivoted responsive to external forces;

a return mechanism interposed between the proximal segment and the display segment;

the frame comprising an access door by which the source of electrical power comprising at least one battery is selectively inserted and removed from the illumination system and through which planar advertising is selectively inserted and removed from within the frame.

4. A cantilevered display assembly according to claim 3 wherein the planar advertising comprises card is encased in a plastic carrier.

5. A cantilevered display assembly comprising:

a distal advertising display segment comprising a frame peripherally disposed in respect to an advertising area, the display segment further comprising a pivotable mounting hanger portion distally connected to the frame at a proximal region of the frame;

a proximal segment comprising a clamp for cantilever mounting the assembly to a molding and a base about which the mounting hanger portion and display segment may be unitarily pivoted responsive to external forces;

a return mechanism interposed between the proximal segment and the display segment;

interrelated male/female structure accommodating pivoting of the distal advertising segment in respect to the proximal segment, the male/female structure comprising a plurality of rounded male projections each disposed compressively and contiguously, under force of the return mechanism, in a matching female recess;

the plurality of rounded male projections and matching female recesses comprising four each spaced from the others, two extending generally vertically and two extending generally horizontally, each male projection comprising a cylindrical-shaped male surface and each female recess comprising a congruent cylindrical-shaped female surface, thereby defining four spaced axes of rotation respectively accommodating (a) pivoting of the advertising display segment to one side about a generally vertical axis, (b) pivoting of the advertising display segment to another side about another generally vertical axis, (c) pivoting of the advertising display segment upwardly about a first generally horizontal axis and (d) pivoting of the advertising display segment downwardly about a second generally horizontal axis, each pivoting action being counter to compression imposed by the return mechanism.

6. A cantilevered display assembly comprising:

a distal advertising display segment comprising a frame peripherally disposed in respect to an advertising area, the display segment further comprising a pivotable mounting hanger portion distally connected to the frame at a proximal region of the frame;

a proximal segment comprising a clamp for cantilever mounting the assembly to a molding and a base about which the mounting hanger portion and display segment may be unitarily pivoted responsive to external forces;

a return mechanism interposed between the proximal segment and the display segment;

the proximal segment and the distal advertising display segment being under compressive force imposed by the return mechanism thereby accommodating pivoting up, down and laterally in either direction;

the proximal segment and the display segment collectively comprising four sets of stops, the stops of each set when contiguously engaging each other limits the extent to which the display segment is permitted to pivot (a) laterally in either direction, (b) upwardly and (c) downwardly.

7. A cantilevered display assembly comprising:

a distal advertising display segment comprising a frame peripherally disposed in respect to an advertising area, the display segment further comprising a pivotable mounting hanger portion distally connected to the frame at a proximal region of the frame;

a proximal segment comprising a clamp for cantilever mounting the assembly to a molding and a base about which the mounting hanger portion and display segment may be unitarily pivoted responsive to external forces;

a return mechanism interposed between the proximal segment and the display segment;

the return mechanism being axially extendible by a predetermined distance and the proximal and distal segments comprising overlapping stops, the distance of the overlap being greater than the predetermined distance whereby substantial twisting rotation of the distal segment in respect to the proximal segment is prevented.

* * * * *